US006142389A

United States Patent [19]

Kynett

[11] Patent Number: 6,142,389

[45] Date of Patent: Nov. 7, 2000

[54] PRESSURE CLEANING FLOW DIVERTER

[76] Inventor: Michael Smith Kynett, 4920 Curling Rd., Virginia Beach, Va. 23455

[21] Appl. No.: 09/139,229

[22] Filed: Aug. 25, 1998

[51] Int. Cl.[7] ..... B05B 1/14

[52] U.S. Cl. ..... 239/447; 239/444

[58] Field of Search ..... 239/444–447

[56] References Cited

U.S. PATENT DOCUMENTS

| | | | |
|---|---|---|---|
| 3,112,073 | 11/1963 | Larson et al. | 239/446 |
| 3,176,924 | 4/1965 | Canavan | 239/444 |
| 3,552,651 | 1/1971 | Garrison | 239/25 |
| 3,565,112 | 2/1971 | Sides | 137/599.1 |
| 3,647,144 | 3/1972 | Park | 239/456 |
| 3,656,503 | 4/1972 | Ward | 137/359 |
| 3,667,683 | 6/1972 | Gilbert | 239/428 |
| 3,680,791 | 8/1972 | Morton | 239/428.5 |
| 3,682,392 | 8/1972 | Kint | 239/428.5 |
| 3,690,565 | 9/1972 | Abos | 239/447 |
| 3,722,798 | 3/1973 | Bletcher | 239/428.5 |
| 3,722,800 | 3/1973 | Shames et al. | 239/447 |
| 3,801,997 | 4/1974 | Ward | 4/191 |
| 3,866,629 | 2/1975 | Nicklas | 137/608 |
| 3,965,937 | 6/1976 | Reber | 137/625.47 |
| 4,221,338 | 9/1980 | Shames | 239/428 |
| 4,264,036 | 4/1981 | Moore | 239/32 |
| 4,281,681 | 8/1981 | Teague | 137/562 |
| 4,379,053 | 4/1983 | Brane | 210/234 |
| 4,448,351 | 5/1984 | Aldinger et al. | 239/447 X |
| 4,503,877 | 3/1985 | Ward | 137/119 |
| 4,609,006 | 9/1986 | Parkin | 137/119 |
| 4,650,470 | 3/1987 | Epstein | 604/149 |
| 4,789,221 | 12/1988 | Crawford | 137/119 |
| 4,934,402 | 6/1990 | Tarnay | 137/119 |
| 4,980,073 | 12/1990 | Woodruff | 210/767 |
| 5,078,176 | 1/1992 | Woodruff | 137/315 |
| 5,096,503 | 3/1992 | Wellman | 134/22.18 |
| 5,188,149 | 2/1993 | William | 137/625.47 |
| 5,279,329 | 1/1994 | Pippel | 137/625.29 |
| 5,573,186 | 11/1996 | Loschelder | 239/445 |
| 5,634,220 | 6/1997 | Chiu | 239/446 X |
| 5,823,441 | 10/1998 | Nicholson | 239/447 X |

*Primary Examiner*—Lesley D. Morris

[57] ABSTRACT

This invention provides a plumbing structure that functions as a highly convenient, flow diverter valve assembly. The flow diverter permits a user to routinely, rapidly, and repeatedly clean surfaces beneath the flow diverter using at least two intersecting streams of fluid. The first stream of fluid is a convention stream of fluid, such as, for example, an aerated stream of fluid from a sink spout. The second stream of fluid is an auxiliary stream of fluid that intersects the first stream of fluid. When a surface, such as the surface of a razor blade, is held in the area where the at least two streams intersect, any foreign matter on the surface, such as hair particles or shaving cream, is rapidly removed by the streams of fluid.

24 Claims, 3 Drawing Sheets

PRESSURE CLEANING FLOW DIVERTER

BACKGROUND OF THE INVENTION

1. Field of the Invention

This invention relates to flow diverters for sinks, bathtubs, and/or showers.

2. Description of Related Art

Aerators on conventional sink spouts have by law and design reduced fluid flow rate considerably in parts of the world. Flow restrictors on conventional shower spouts have done the same. Consequently, it has become difficult to concentrate sink, shower, or bathtub fluid pressure enough to effectively remove stuck or jammed foreign material from some surfaces placed in the fluid flow. Though the conventional sink and conventional shower spout flow restrictors save fluid and/or reduce splatter, some disadvantages have remained.

For example, body hair jams up around shaving razor blades when hair is cut with modem single or twin blade straight razors or rotary razors. Razor companies have tried to solve this problem by many methods. Brushes have been provided to clean rotary blades which is time consuming and hard on fingers. Some twin blade razors have plastic tabs between the twin razor blades to push out shaved hair ends from around blades. These tabs eventually fail to retract. This retraction failure prohibits the blades from cutting efficiently, well before blades have become too dull for shaving. For twin or single blade razors without plastic cleaning tabs, some people attempt tedious razor cleaning.

Collar stays, toothpicks, rubber pointy end of toothbrushes, or other thin stiff devices are commonly used to clear jammed hair. Banging razors on the side of the sink, shower, or bathtub to eject hair is another razor damaging technique. Use of probe devices on blades or banging razors to eject hair dulls the blades unnecessarily. Banging can break razor parts, well before the blade reached the end of its useful life. Banging can unnecessarily wake up those sleeping within earshot of the banging. Partially successful blade banging, probing, or brushings repeatedly are all disadvantaged methods because they utilize excess amounts of usually hot water.

SUMMARY OF THE INVENTION

These and other disadvantaged cleaning methods are necessary because there is a present lack of highly convenient concentrated fluid pressure to effectively rinse surfaces clear. None of the prior art flow diverters cited address this issue. All prior art flow diverters have different structures, and are designed for different functions, or are designed to provide a different result.

Sinks, showers, and bathtubs need a highly convenient, relatively fixed selectable plumbing structure which functions to allow a user to routinely, rapidly, and repeatedly clean surfaces using at least a single stream of concentrated fluid pressure.

Accordingly, this invention provides for the routine, rapid and repeated use of this highly convenient pressure cleaning flow diverter to clean surfaces placed beneath the conventional faucet or spout using concentrated fluid pressure. Concentrated fluid pressures from this highly convenient, relatively fixed plumbing device can clean numerous items faster, with less hot or cold water than used previously. This will save water, time, energy for heating the hot water, and money previously spent on energy and water. Items that were previously consumed at a higher rate due to the non-availability of concentrated fluid pressure sources from convenient, relatively fixed devices, can now have their life extended using the methods and apparatuses of this invention.

Several objects and advantages of this pressure cleaning flow diverter are that time, water, money spent on water, water heating energy, and money spent on water heating energy are saved. Sink, shower, and bathtub users can now routinely, rapidly and repeatedly utilize new structures that function to provide highly convenient, concentrated fluid pressure for clearing and cleaning from a relatively fixed selectable device.

An additional object and advantage of this pressure cleaning flow diverter is that items can now have their life extended using this or similar envisioned devices that produce acceptable cleaning results without the wear and tear associated with prior cleaning methods. Still further objects and advantages will become apparent from a consideration of the ensuing description and accompanying drawings.

In various exemplary embodiments, diverted fluid flow direction could be limited to fewer or even one diverted outlet redirected down into the sink or intersect/combine with the aerated water. Less fluid terminal outlet ports would increase fluid velocity and force.

Shower plumbing can also be modified to provide concentrated fluid pressure near the shower valve or valves out through the shower wall via a conduit which transports fluid to a constricted venturi fluid passage which provides a downward directed fluid jet into the shower. T-fittings could be put in shower fluid supply conduit before or after shower valve to supply fluid. Fluid would then go out through the shower wall via a conduit, which transports fluid to a constricted venturi fluid passage, which provides a downward, directed fluid jet into the shower.

A T-fitting between the showerhead and the pipe the showerhead is connected to could also be installed. A flexible or ridged line could then be installed which is first routed back to the wall from which the shower head fluid supply emerges, then down along same wall to the convenient height for the user. Numerous methods could be used to keep conduit in place.

Next, a flow diverter is firmly anchored to shower wall and connected to conduit. The flow diverter could delete the primary exit hole and be attached to either above fluid piping assembly. When the showerhead is pressurized, fluid can be let out the flow diverter on demand with said flow diverter control valve.

The shower flow diverter fluid supply conduit could also be tied in to the fluid supply upstream of the shower faucets to supply fluid jet action even if the shower is turned off. Showerheads could be reinvented as well as being downstream of an in line redesigned flow diverter. Conventional bathtub spouts with or without shower diverter valves can be reinvented to provide concentrated fluid pressure from an additional valve built into spout housing. Bathtub spouts with or without shower diverter valves can have exiting aerators removed and replaced with a low resistance flow diverters that can provide a full time or on demand highly convenient pressure cleaning flow diverter.

Thus, the systems, methods, and apparatuses of this invention provide a flow diverter that provides a highly convenient, routine, rapid and easily repeatable cleaning and clearing function to surfaces placed beneath it.

These and other features and advantages of this invention are described in or are apparent from the following detailed description of the exemplary embodiments. Thus, the scope of the invention should be determined by the appended claims and their legal equivalents, rather than by the examples given.

BRIEF DESCRIPTION OF THE DRAWINGS

The exemplary embodiments of this invention will be described in detail, with reference to the following figures, wherein.

DETAILED DESCRIPTION OF THE PREFERRED EMBODIMENT

For simplicity and clarification, the embodiments of this invention will be described with reference to the flow diverter systems, methods, and apparatuses as they operate when attached to a conventional sink spout. Alternatively, the systems, methods, and apparatuses of this invention can be attached to other sources of pressurized fluid, such as, for example, a tub spout, a showerhead, or the like.

It should also be appreciated that the term "flow diverter" is for basic explanation and understanding of the operation of the systems, methods, and apparatuses of this invention. Therefore, the term "flow diverter" is not to be construed as limiting the systems, methods, and apparatuses of this invention.

Figure 1:
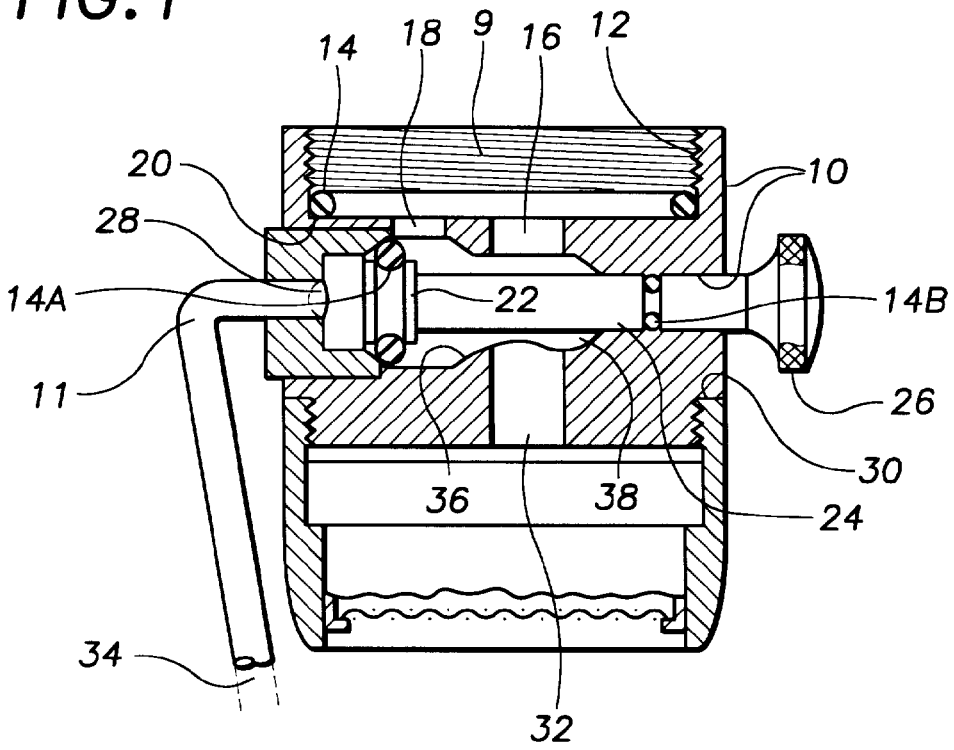
FIG. 1 shows a first exemplary embodiment of a flow diverter according to this invention.

FIG. 1 shows a first exemplary embodiment of a pressure cleaning flow diverter. In various exemplary embodiments, the flow diverter can start out as a piece of round bar stock of a metal, plastic, or ceramic material or the like. Material should be found capable of withstanding installation torque and typical city water pressures provided to body washing stations. Body washing stations are defined as sinks, bathtubs, with and without shower plumbing accessories and showers stalls.

As shown in FIG. 1, a threaded mass fluid inlet hole 12 is cut into diverter body 10 top which is threaded to receive a conventional sink spout, a conventional bathtub spout, or be placed in a conventional shower fluid supply conduit. In various exemplary embodiments, various other adapters may be used for a successful attachment to these conventional spouts and conduits.

The threads of hole 12 descend and terminate prior to the bottom of hole 12. "O" ring 14 is inserted and fits between bottom of hole 12 and where threads stop in hole 12. "O" ring 14 seals diverter body 10 to a fluid source conduit which prevents pressurized fluid leakage.

A primary valve fluid inlet hole 16 is drilled down vertically just off center, completely through the rest of diverter body 10. An alternate valve fluid inlet hole 18 is drilled vertically down from the bottom inside edge of hole 12, only partially penetrating diverter body 10.

An intersecting horizontal hole 20 with four concentrically smaller diameters is drilled completely through diverter body 10 to intersect hole 18, and hole 16. Once drilled, hole 20 top is the bottom of hole 16. The rest of what was hole 16 is now a primary fluid exit hole 32.

A piston head 22 with a shaft 24 is slidably mounted horizontally into the large end of intersecting horizontal hole 20, shaft first. A detachable control knob 26 is attached to shaft 24 end opposite piston head 22, once shaft 24 has been inserted through hole 20 and shaft end extends out of side of diverter body 10. An "O" ring 14A is placed around the circumference of piston head 22 to prevent fluid from horizontally exiting out large end of intersecting horizontal hole 20 when piston head 22 is in the closed position. A groove is place in piston head 22 to hold "O" ring 14A so "O" ring 14A is retained as piston head 22 slides back and forth. An "O" ring 14B is placed around shaft 24 to prevent fluid from horizontally exiting diverter body 10 around shaft 24. A small groove is cut into shaft 24 to retain "O" ring 14B as shaft 24 slides back and forth.

A constricted venturi fluid passage 11 is receiveably mounted into widest and first diameter of intersecting horizontal hole 20. Passage 11 creates a downward directed fluid jet stream 34, which can remove an accumulation or foreign matter from a surface. Passage 11 is shaped to direct jet stream 34 so that it intersects with fluid exiting aerator body 30 prior to either descending fluid hitting bottom of sink. Passage 11 is fastened by pressing passage 11 into hole 20 prepared with glue, or threading hole 20 and passage 11. Hole's 20 second widest diameter is for horizontal piston head 22 travel.

Piston head 22 hits a piston travel stop 36 as hole 20 transitions smaller to a fluid routing chamber 38. The smallest diameter part of hole 20 travels from the outward end of the fluid routing chamber 38 through the outside edge of diverter body 10.

In various exemplary embodiments, the outside bottom of diverter body 10 has male threads cut to receive female threaded aerator body 30. In various other exemplary embodiments, the outside bottom of diverter body 10 does not include any threads and the aerator body 30 is not attached to the diverter body 10.

FIG. 1 The method of operating a flow diverter 9 for the purpose of removing foreign matter from a surface or surfaces, in which a user orders and selects whatever steps the user thinks will achieve his or her goal, ordering and selecting desired steps from the below method comprised of: connecting a fluid to a flow diverter 9 and flow diverter 9 has a single or plurality of undiverted through flow inlets (16 & 18) and flow diverter 9 has a single or plurality of diverted flow exits (28 & 32) and flow diverter 9 is designed to direct at least some of fluid through integrated or attached constricted venturi fluid passage 11 that creates a downward directed fluid jet stream 34 or streams of fluid into the atmosphere, and constricted venturi fluid passage 11 provides downward directed fluid jet stream 34 or streams of fluid at a amplified velocity and amplified force which is greater than the velocity and force of any other undiverted or diverted fluid exiting to the atmosphere from any other integral or attached passage of flow diverter 9; moving a control (22 & 24 & 26) of flow diverter 9 if equipped, which allows some or all of fluid entering flow diverter 9 to exit a alternate fluid exit 28 port or ports of which control (22 & 24 & 26) has control; turning on faucet or faucets to connect fluid to flow diverter body 10; placing a surface or surfaces like a razor blade, razor blades, razor blade housings, straws, tubing or the like into downward directed fluid jet stream 34 or a aerated fluid's exiting flow to allow velocity of fluid to remove a accumulation of debris from surface or surfaces; adjusting faucet or faucets which may in turn adjust fluid's exiting velocity or velocities out flow diverter's constricted venturi fluid passage 11; removing surface or surfaces repeatedly to inspect for cleanliness or further cleaning needs; turning off faucet or faucets between cleanings and at end of an cleaning event if desired.

The detailed operation that follows refers to FIG. 1. Diverter body 10 top threads are mounted onto a sink, shower, or bathtub faucet, with or without an adapter. Fluid will flow straight through small primary valve inlet hole 16, fluid routing chamber 38 and out primary exit hole 32 regardless of piston head 22 position. When piston head 22 is pushed in via detachable control knob 26 and shaft 24, outward fluid flow is cut off from alternate fluid exit hole 28 and constricted venturi fluid passage 11. When knob 26 is pulled out, hole 28 is opened, allowing fluid to create a downward directed fluid jet stream 34 upon exiting constricted venturi fluid passage 11. When knob 26 is pulled out fluid continues to flow through chamber 38 and out primary exit hole 32. The rate of flow out constricted venturi fluid passage 11 can be controlled either by the valve from which the fluid is sourced or by direct adjustment of shaft 24. Shaft 24 adjustment guards the user from ever allowing too much fluid into the constricted venturi fluid passage 11, which could splatter when items get in the exiting fluid's path. This embodiment allows the user to pull knob 26 until piston head 22 contacts piston travel stop 36. Fluid flow is then controlled via the upstream valve. For sink applications or bathtub applications, an aerator body 30 is threaded onto diverter body 10 and receives fluid flow whenever faucet allows fluid into diverter body 10. By design, fluid exiting constricted venturi fluid passage 11 is directed to intersect fluid exiting aerator body 30. This minimizes sink bowl splatter in between uses of concentrated fluid flow for cleaning or clearing and allows higher volumetric flow when filling bathtub. Aerator body 30 receives fluid through hole 32 whenever the fluid comes into diverter body 10 from the fluid source to which it is attached.

The routine, rapid and repeated use of this highly convenient pressure cleaning flow diverter to clean surfaces placed beneath the conventional faucet or spout using concentrated fluid pressure has many benefits. Concentrated fluid pressures from this highly convenient, relatively fixed plumbing device can now clean numerous items faster, with less hot or cold water than used previously. This will save water, time, energy for heating the hot water, and money previously spent on energy and water. Items that were previously consumed at a higher rate due to the non- availability of concentrated fluid pressure sourced from convenient, relatively fixed devices, can now have their life extended using this or similar envisioned devices that achieve the same end state.

Figure 2:
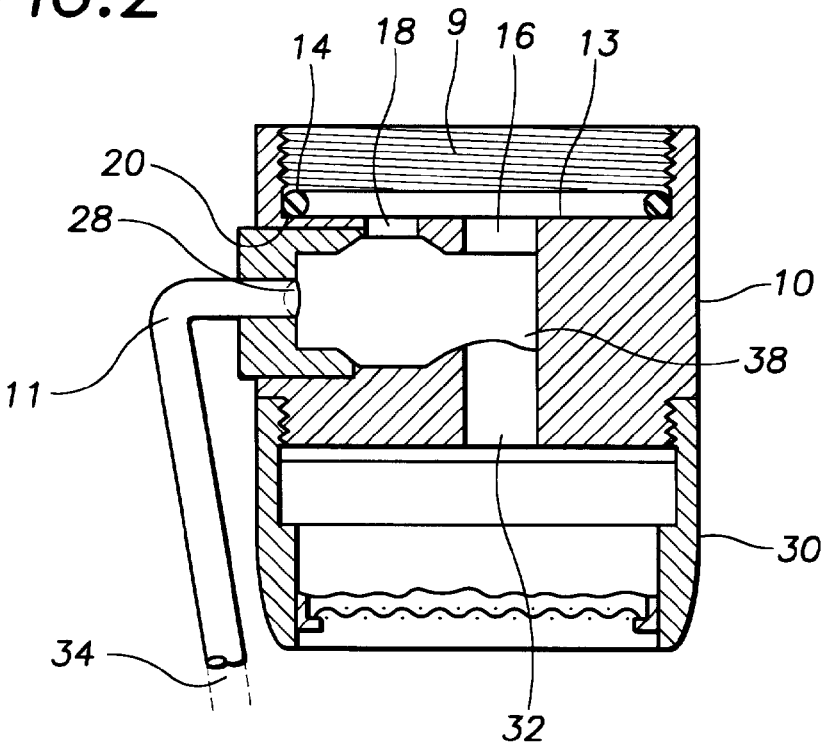
FIG. 2 shows a second exemplary embodiment of a flow diverter according to this invention.

FIG. 2 shows a second exemplary embodiment of a pressure cleaning flow diverter. The elements of the flow diverter of FIG. 2 correspond to and operate similarly to the same elements discussed above with respect to the flow diverter of FIG. 1. However, in various exemplary embodiments, the flow diverter of FIG. 2 does not include the piston head 22, the shaft 24, or the detachable control knob 26.

As shown in FIG. 2 embodiment is a flow diverter 9 with a diverter body 10 constructed of metal, plastic or ceramic and capable of diverting fluid. The diverter body 10 includes, a mass fluid inlet hole 13, a 32 primary fluid exit hole, and one fluid exit point that further directs undispersed, unaerated or untreated fluid either through at least one but less than four integral constricted venturi fluid passageways which terminates downward into the sink shower or bathtub, or through at least one but less than four attached constricted venturi fluid passageways which terminates downward into the sink, shower or bathtub, and constricted venturi fluid passage provides downward directed fluid jet streams at a amplified velocity and amplified force which is capable of being greater than the velocity and force of any other fluid terminating to the atmosphere from any other fluid passage of flow diverter. Thus, amplified fluid pressure and force can be utilized to clear foreign matter from at least one surface placed beneath fluid flow.

In various exemplary embodiments, the mass fluid inlet hole 13 is a single fluid inlet. In various other exemplary embodiments, the mass fluid inlet hole 13 is a plurality of fluid inlets. Additionally, in various exemplary embodiments, the primary fluid exit hole 32 is a single fluid exit. In various other exemplary embodiments, the primary fluid exit hole 32 is a plurality of fluid exits.

Hole 16 and 18 may be combined into one properly sized inlet hole, which allows same volumetric flow as two smaller holes. Passage 11 may be shortened so it is flush with diverter body bottom.

This unique structure performs a new function that provides the new and unexpected result of full time aerated water and full time waterjet with insignificant splatter due to the waterjet stream intersecting the aerated stream prior to either stream arriving at the sink or bathtub bottom.

In various exemplary embodiments, the outside bottom of diverter body 10 has male threads cut to receive female threaded aerator body 30. In various other exemplary embodiments, the outside bottom of diverter body 10 does not include any threads and the aerator body 30 is not attached to the diverter body 10.

During operation, the diverter body 10 of FIG. 2 allows either aerated or unaerated fluid to exit diverter body 10 whenever fluid flows into intersecting horizontal hole 20. Some who do not care for pulling and pushing tabs or saving water may want full time fluid flow from downward directed fluid jet 34, or primary fluid exit hole 32 regardless of water savings.

Figure 3:
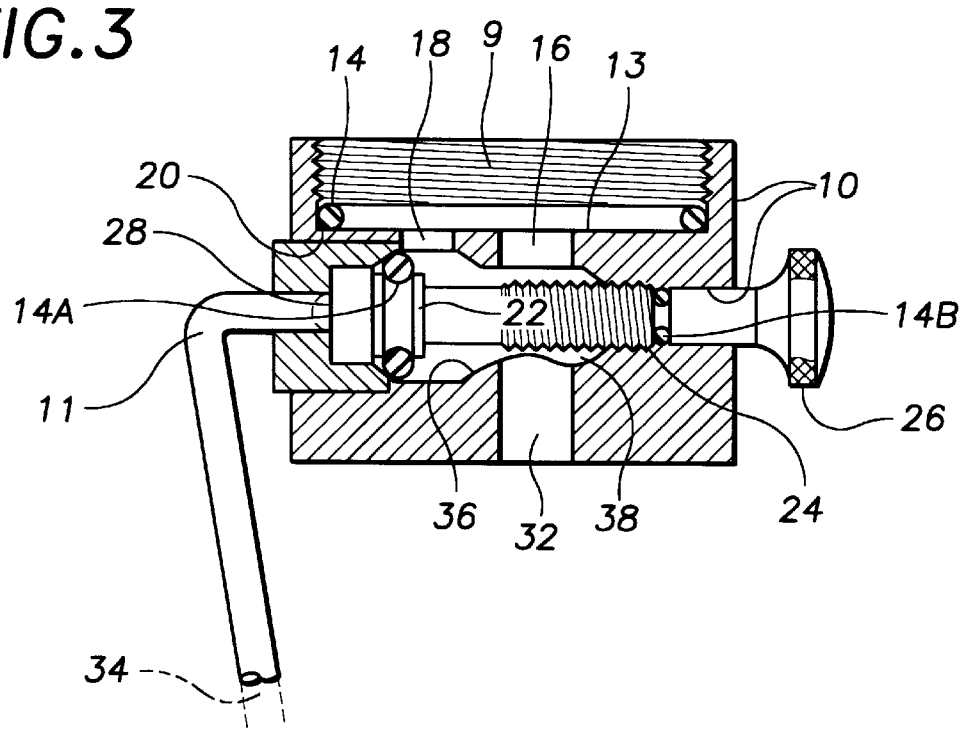
FIG. 3 shows a third exemplary embodiment of a flow diverter according to this invention.

FIG. 3 shows a third exemplary embodiment of a pressure cleaning flow diverter. The elements of the flow diverter of FIG. 3 correspond to and operate similarly to the same elements discussed above with respect to the flow diverter of FIG. 1. However, in various exemplary embodiments, the flow diverter of FIG. 3 includes a threaded adjustment on the shaft 24 and corresponding threads cut into the diverter body 10.

Thus, as shown in FIG. 3, a user can more precisely set the maximum desired fluid flow rate exiting from downward directed fluid jet 34, regardless of upstream valve position by turning detachable control knob 26 clockwise to reduce flow or counterclockwise to increase flow.

Figure 4:
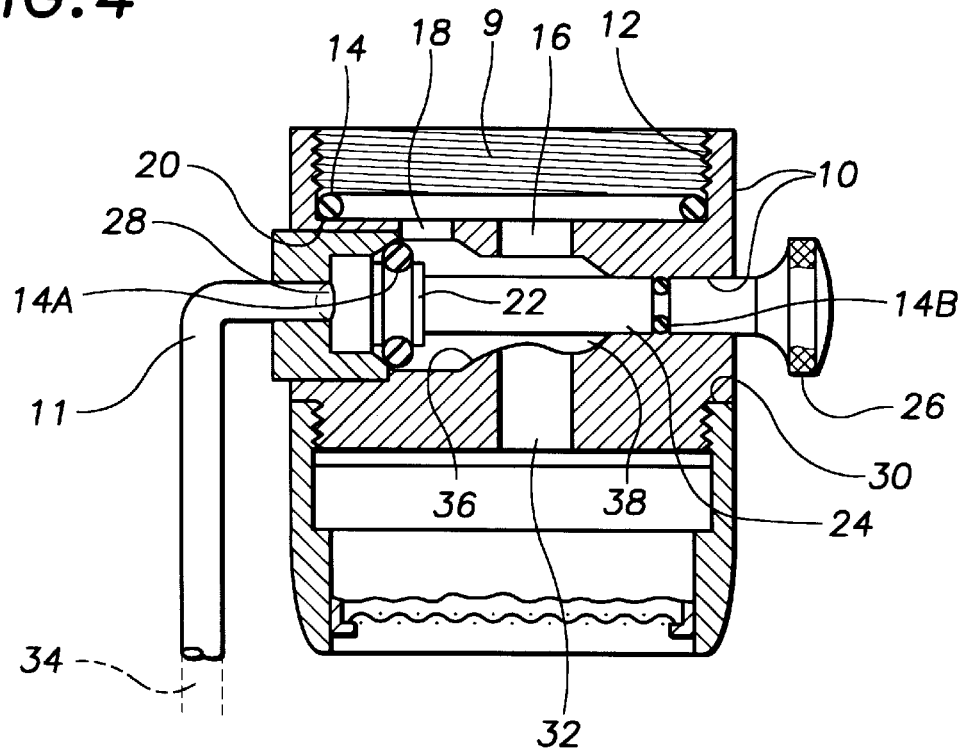
FIG. 4 shows a fourth exemplary embodiment of a flow diverter according to this invention.

FIG. 4 shows a fourth exemplary embodiment of a pressure cleaning flow diverter. The elements of the flow diverter of FIG. 4 correspond to and operate similarly to the same elements discussed above with respect to the flow diverter of FIG. 1. However, in various exemplary embodiments, the constricted venturi fluid passage 11 of the flow diverter of FIG. 4 diverts downward directed fluid jet 34, to contact the sink bottom instead of intersecting the aerated fluid flow prior to the aerated fluid flow impacting the sink bottom. This could be combined with a threaded or unthreaded shaft 24.

Thus, fluid is not intended to intersect aerated fluid flow prior to impacting sink bottom. This angle of exit from downward directed fluid jet 34 could be desirable when utilized in the shower or bathtub.

Figure 5:
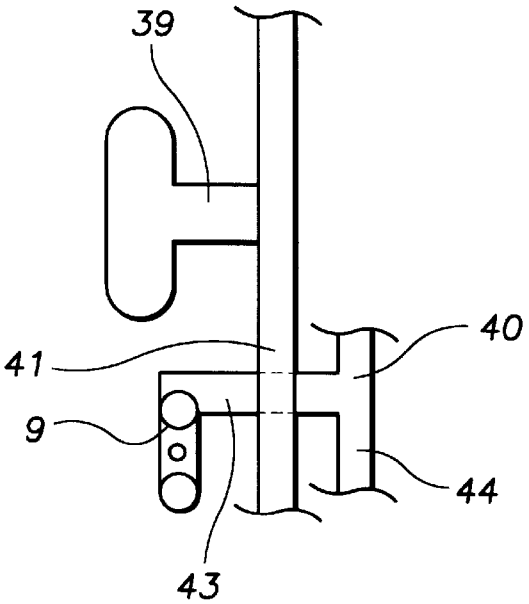
FIG. 5 shows a first exemplary embodiment of a flow diverter system according to this invention.

FIG. 5 shows a first exemplary embodiment of a flow diverter system according to this invention. As shown in Fig, 5, fluid flows to flow diverter 9 from shower fluid supply conduit 44 via a attached T-fitting 40 and through fluid conduit 43, which passes through shower wall 41. T-fitting 40 can be tied into fluid supply conduit either before or after faucet control.

Thus, when fluid is routed to flow diverter 9, fluid is prevented from coming out until detachable control knob 26 is pulled or turned, depending on configuration.

Figure 6:
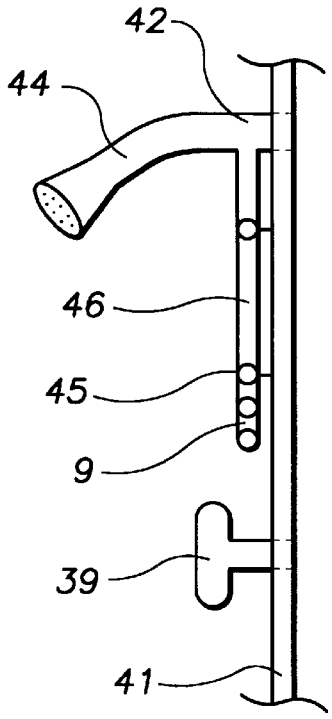
FIG. 6 shows a second exemplary embodiment of a flow diverter system according to this invention.

FIG. 6 shows a second exemplary embodiment of a flow diverter system according to this invention. As shown in FIG. 6, a threaded T-fitting 42 attaches a shower fluid supply conduit 44 exiting shower wall 41. Flexible fluid conduit 46 is fastened to 42 and to the wall at appropriate places to hold it firmly out of the way with flexible fluid conduit retainer brackets 45. Flexible fluid conduit 46 descends until reaching a convenient height. Flow diverter 9 is then fastened to the end of flexible fluid conduit 46 for use. Primary valve fluid inlet hole 16 and primary fluid exit hole 32 are eliminated from preferred embodiment's description as well as threads for aerator body and aerator body.

During operation of the flow diverter system of FIG. 6, when the shower head is receiving fluid, so is the flow diverter through T-fitting 42 and flexible fluid conduit 46. Fluid is prevented from exiting flow diverter body 10 until detachable control knob 26 is pulled or turned, depending on configuration.

Figure 7:
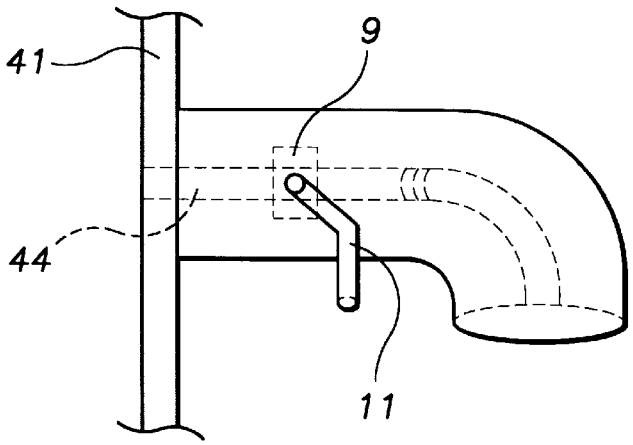
FIG. 7 shows a third exemplary embodiment of a flow diverter system according to this invention.

FIG. 7 shows a third exemplary embodiment of a flow diverter system according to this invention. As shown in FIG. 7, the enlarged flow diverter 9, is encased in a conventional bathtub spout 47 which may or may not have a shower diverter valve built into conventional bathtub spout 47.

The flow diverter 9 is attached to the fluid conduit coming out of the wall above the bathtub or coming up through the bathtub lip from below. Bathtub spout will then attach to flow diverter 9, and possibly shroud around diverter, with conventional bathtub spout 47 shroud touching wall or bathtub top. A shower diverter valve, if incorporated into bathtub spout, will not be adversely affected by flow diverter 9 position or use. Conventional bathtub spout 47 will have holes aligned to allow protrusion of detachable control knob 26 and constricted venturi fluid passage 11 means.

Thus, the flow diverter system of FIG. 7 will work regardless of bathtub spout's shower fluid diverter position, if incorporated. When a user desires to shave in the bathtub or shower he or she merely pulls out the detachable control knob 26, as shown in FIG. 1. When fluid is routed to conventional bathtub spout, some of fluid will be routed to constricted venturi fluid passage 11 creating a downward directed fluid jet stream 34. The user may desire to use shaft 24 to control and terminate fluid flow during and between downward directed fluid jet stream 34 usages while the user need only use upstream valve to terminate downward directed fluid jet stream 34 between usages.

Although the description above contains many specificities, these should not be construed as limiting the scope of the invention but as merely providing illustrations of some of the presently preferred embodiments of this invention. Various other embodiments and ramifications are possible within its scope. For example, other flow diverters could be reinvented to allow constant flow of fluid through to the non-diverted fluid exit port regardless of diverter valve position, though these designs would be more expensive.

What is claimed is:

1. A flow diverter, comprising:

a diverter body having opposite open ends;

a central barrier disposed in the diverter body between the opposite open ends and defining an input chamber associated with a first open end of the opposite open ends and an output chamber associated with a second open end of the opposite open ends;

wherein the central barrier includes at least one main passage portion that provides at least one main outlet for a flow of fluid from the input chamber to the output chamber and an auxiliary passage portion that provides an auxiliary outlet for a flow of at least some of the flow of fluid from the input fluid flow; and an auxiliary fluid discharge conduit attached to the auxiliary passage portion;

wherein the auxiliary fluid discharge conduit directs at least one fluid stream to intersect a flow of fluid from the main outlet.

2. The flow diverter of claim 1, wherein the flow diverter is constructed of metal, plastic, or ceramic.

3. The flow diverter of claim 1, wherein the first open end includes a coupling means.

4. The flow diverter of claim 3, wherein the coupling means is a threaded coupling means.

5. The flow diverter of claim 3, wherein the first open end is coupled to a pressurized fluid source.

6. The flow diverter of claim 1, wherein the second open end includes a coupling means.

7. The flow diverter of claim 6, wherein the coupling means is a threaded coupling means.

8. The flow diverter of claim 6, wherein the second open end is attached to a fluid discharge means.

9. The flow diverter of claim 6, wherein the fluid discharge means is a fluid aerator.

10. The flow diverter of claim 1, further including a user operated fluid controller that controls the flow of fluid from the input chamber to the auxiliary passage portion of the flow diverter.

11. The flow diverter of claim 10, wherein the fluid controller is adjustably connected within the flow diverter.

12. The flow diverter of claim 10, wherein the fluid controller is slideably connected within the flow diverter.

13. The flow diverter of claim 1, further including a bathtub spout housing that includes the flow diverter within the bathtub spout housing.

14. A flow diverter, comprising:

a diverter body having opposite open ends;

a central barrier disposed in the diverter body between the opposite open ends and defining an input chamber associated with a first open end of the opposite open ends and an output chamber associated with a second open end of the opposite open ends;

wherein the central barrier includes at least one main passage portion that provides at least one main outlet for a flow of fluid from the input chamber to the output chamber and an auxiliary passage portion that provides an auxiliary outlet for a flow of at least some of the flow of fluid from the input fluid flow; and wherein the auxiliary fluid passage creates at least one directed fluid stream that intersects the fluid flow from the main outlet.

15. The flow diverter of claim 14, wherein the first open end is connected to a pressurized source of fluid.

16. A flow diverter, comprising:

a diverter body having opposite open ends;

a central barrier disposed in the diverter body between the opposite open ends and defining an input chamber associated with a first open end of the opposite open ends and an output chamber associated with a second open end of the opposite open ends;

wherein the central barrier includes at least one main passage portion that provides at least one main outlet for a flow of fluid from the input chamber to the output chamber and an auxiliary passage portion that provides an auxiliary outlet for a flow of at least some of the flow of fluid from the input fluid flow; and wherein the auxiliary fluid passage creates at least one directed fluid stream parallel to the fluid flow from the main outlet.

17. The flow diverter of claim 16, wherein the first open end is connected to a pressurized source of fluid.

18. A method of using a flow diverter to remove foreign matter from at least one surface, wherein the flow diverter includes:

a diverter body having opposite open ends;

a central barrier disposed in the diverter body between the opposite open ends and defining an input chamber associated with a first open end of the opposite open ends and an output chamber associated with a second open end of the opposite open ends;

wherein the central barrier includes at least one main passage portion that provides at least one main outlet for a flow of fluid from the input chamber to the output chamber and an auxiliary passage portion that provides an auxiliary outlet for a flow of at least some of the flow of fluid from the input fluid flow; and wherein the auxiliary fluid passage creates at least one directed fluid stream that intersects the fluid flow from the main outlet, the method comprising:

connecting the flow diverter to a source of pressurized fluid;

turning on the source of pressurized fluid;

placing the at least one surface in an area where the at least one directed fluid stream intersects the fluid flow from the main outlet; and allowing the at least one directed fluid stream or the fluid flow from the main outlet to satisfactorily remove at least a portion of the foreign matter from the at least one surface.

19. The method of claim 18, wherein said surface is at least one razor blade.

20. A method of using a flow diverter to remove foreign matter from at least one surface, wherein the flow diverter includes:

a diverter body having opposite open ends;

a central barrier disposed in the diverter body between the opposite open ends and defining an input chamber associated with a first open end of the opposite open ends and an output chamber associated with a second open end of the opposite open ends;

wherein the central barrier includes at least one main passage portion that provides at least one main outlet for a flow of fluid from the input chamber to the output chamber and an auxiliary passage portion that provides an auxiliary outlet for a flow of at least some of the flow of fluid from the input fluid flow;

wherein the auxiliary fluid passage creates at least one directed fluid stream that intersects the fluid flow from the main outlet; and a user operated fluid controller that controls the flow of fluid from the input chamber to the auxiliary passage portion of the flow diverter, the method comprising:

connecting the flow diverter to a source of pressurized fluid;

turning on the source of pressurized fluid;

moving the user operated fluid controller from a first position that directs all of the fluid to flow to the main outlet to a second position that directs at least some of the fluid to flow to the auxiliary passage portion of the flow diverter;

placing the at least one surface in an area where the at least one directed fluid stream intersects the fluid flow from the main outlet;

allowing the at least one directed fluid stream or the fluid flow from the main outlet to satisfactorily remove at least a portion of the foreign matter from the at least one surface; and moving the user operated fluid controller from the second position to the first position when at least a portion of the foreign matter is satisfactorily removed from the at least one surface.

21. The method of claim 20, wherein said surface is at least one razor blade.

22. The method of claim 20, wherein said surface is a straw.

23. The method of claim 20, wherein said surface is a length of tubing.

24. A method of using a flow diverter to remove foreign matter from at least one surface, comprising:

connecting the flow diverter to a source of pressurized fluid;

turning on the source of pressurized fluid;

placing the at least one surface in an area where at least one directed fluid stream intersects a fluid flow from a main fluid outlet; and allowing the at least one directed fluid stream or the fluid flow from the main fluid outlet to satisfactorily remove at least a portion of the foreign matter from the at least one surface.

* * * * *